US007803252B2

(12) United States Patent
Martikainen et al.

(10) Patent No.: US 7,803,252 B2
(45) Date of Patent: Sep. 28, 2010

(54) FABRIC STRUCTURE FOR USE IN PAPER MACHINE AND MANUFACTURING METHOD THEREOF

(75) Inventors: Hannu Martikainen, Kuopio (FI); Pekka Kortelainen, Juankoski (FI); Tania Rautio, Riistavesi (FI); Mari Seppanen, Juankoski (FI); Ali Harlin, Vantaa (FI); Tuula Wilenius-Jaakonaho, Tampere (FI)

(73) Assignee: Tamfelt PMC Oy, Tampere (FI)

( * ) Notice: Subject to any disclaimer, the term of this patent is extended or adjusted under 35 U.S.C. 154(b) by 785 days.

(21) Appl. No.: 11/632,777

(22) PCT Filed: Sep. 12, 2005

(86) PCT No.: PCT/FI2005/050313

§ 371 (c)(1),
(2), (4) Date: Jan. 18, 2007

(87) PCT Pub. No.: WO2006/030066

PCT Pub. Date: Mar. 23, 2006

(65) Prior Publication Data

US 2007/0292663 A1 Dec. 20, 2007

(30) Foreign Application Priority Data

Sep. 13, 2004 (FI) ..... 20045337

(51) Int. Cl.
*D21F 1/10* (2006.01)

(52) U.S. Cl. ..... 162/348; 162/903; 428/196; 427/288

(58) Field of Classification Search ..... 162/116, 162/348, 358.1, 358.2, 361, 900–904; 139/383 A; 428/194, 195.1, 196; 427/288
See application file for complete search history.

(56) References Cited

U.S. PATENT DOCUMENTS

| | | | | |
|---|---|---|---|---|
| 4,501,303 | A | 2/1985 | Osterberg | |
| 4,654,122 | A | 3/1987 | Bachmann et al. | |
| 4,731,281 | A * | 3/1988 | Fleischer et al. | 428/196 |
| 4,746,546 | A | 5/1988 | Bachmann et al. | |
| 4,981,745 | A * | 1/1991 | Lefkowitz | 428/147 |
| 5,077,116 | A | 12/1991 | Lefkowitz | |
| 5,084,326 | A | 1/1992 | Vohringer | |
| 5,207,873 | A | 5/1993 | Sanduja et al. | |
| 5,397,438 | A * | 3/1995 | Nyberg et al. | 162/207 |

(Continued)

FOREIGN PATENT DOCUMENTS

CN 1193672 A 9/1998

(Continued)

OTHER PUBLICATIONS

Translation of Mar. 23, 2010 Chinese Office Action for Chinese Patent Application No. 200580030626.6.

*Primary Examiner*—Eric Hug
(74) *Attorney, Agent, or Firm*—Oliff & Berridge, PLC

(57) ABSTRACT

The invention relates to a flexible and porous fabric structure comprising a support structure (1) and a coating material for use in a paper machine. The coating material (2) is arranged solely on the surface of the support structure (1) at a predefined location(s) so that the coating material (2) does not substantially alter the permeability properties of the support structure (1). The invention also relates to a method for manufacturing a fabric structure.

32 Claims, 2 Drawing Sheets

U.S. PATENT DOCUMENTS

Figure 1:
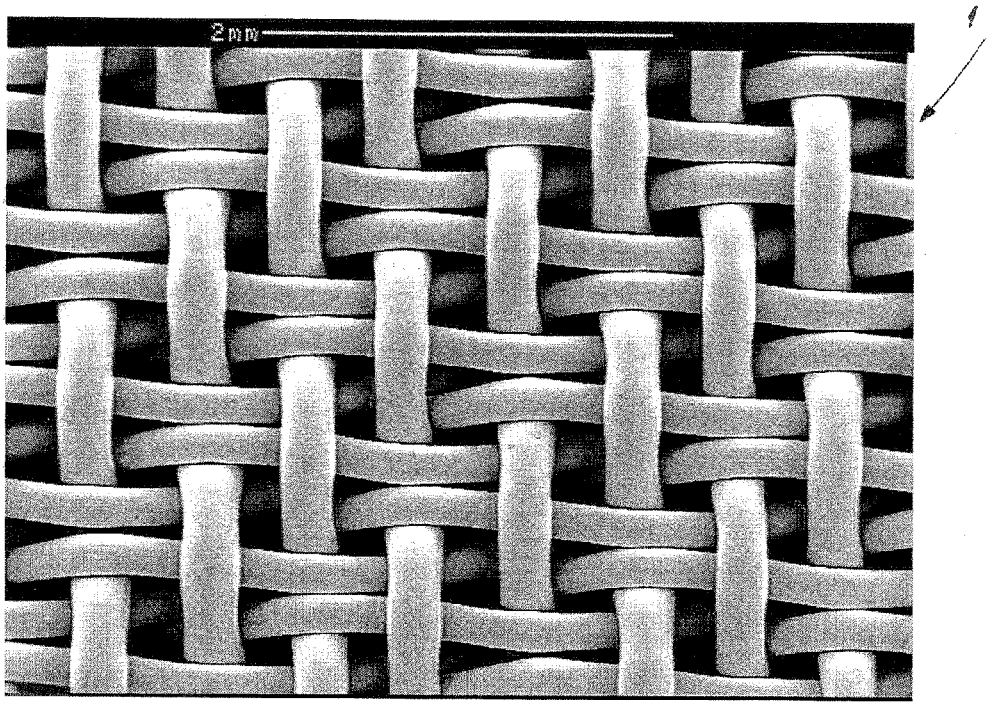

| | | | | |
|---|---|---|---|---|
| 5,731,059 | A * | 3/1998 | Smith et al. | 428/192 |
| 5,826,627 | A | 10/1998 | Seabrook et al. | |
| 5,888,915 | A * | 3/1999 | Denton et al. | 442/200 |
| 5,967,195 | A | 10/1999 | Ward | |
| 6,123,116 | A | 9/2000 | Ward et al. | |
| 6,179,013 | B1 | 1/2001 | Gulya | |
| 6,197,158 | B1 | 3/2001 | Steiner | |
| 6,284,380 | B1 | 9/2001 | Martin et al. | |
| 7,022,208 | B2 * | 4/2006 | Davenport et al. | 162/358.2 |
| 2004/0126544 | A1 | 7/2004 | Jaglowski et al. | |

FOREIGN PATENT DOCUMENTS

| | | | |
|---|---|---|---|
| EP | 0 493 756 | A1 | 7/1992 |
| EP | 0 860 544 | A2 | 8/1998 |
| GB | 980057 | | 1/1965 |
| WO | WO 90/14465 | A1 | 11/1990 |

* cited by examiner

FABRIC STRUCTURE FOR USE IN PAPER MACHINE AND MANUFACTURING METHOD THEREOF

The invention relates to a flexible and porous fabric structure comprising a support structure and a coating material for use in a paper machine. The invention also relates to a method for manufacturing a flexible and porous fabric structure for use in a paper machine.

Flexible and porous fabric structures are used in different parts of a paper machine, for instance in the wet end, press section, and drying section.

During the last few years, the velocities of paper machines have increased. In 20 years, the design velocities of paper machines have doubled and are principally ≧2,000 m/min. At the moment, the actual maximum driving speeds of paper machines are ≧1,800 m/min. These fast paper machines require new properties of the fabric structures, such as wet wires, used therein. One of the most important properties of the wet wire is its stability. The stability of a wet wire refers to its dimensional stability. An example of poor stability is extensive narrowing of the wet wire during tightening or its running obliquely if the rolls of the paper machine are not exactly aligned. A second important property is the thickness of a wet wire. Fast machines require ever thinner wet wires. As the paper machine velocities increase, the water amounts to be removed from the paper web also increase, i.e. the dewatering ability of the paper machine fabric must be sufficient even at high speeds. A thin wet wire has a better dewatering ability than a thick one. A conflict arises from the fact that the fabric needs to be simultaneously thin and stable.

Various solutions have been developed to solve the above-mentioned problems. Examples of prior-art solutions are SSB structures related to wet wires. SSB comes from the words sheet support binder (later SSB) that refer to structures having two separate layers that are bound together with binding yarns that also participate in forming the paper-side surface. In other words, the binding yarns act as both binding yarns and yarns supporting the fibres. This art is described for instance in U.S. Pat. Nos. 4,501,303, 5,967,195 and 5,826,627. SSB structures provide the stability required by paper machines, but a problem arises from the thickness of the fabric structure and, consequently, the large water space. Water space can be decreased by making the SSB structures thinner by making the yarns thinner, as described in U.S. Pat. Nos. 6,123,116 and 6,179,013. However, this brings back the original problem, poor stability.

Another example of a prior-art solution is the use of various coatings. Different coatings have long been used on wet wires. However, they have only been used for specific purposes, in other words, they provide a dirt repellent surface on the wet wire, but the other properties of the wet wire remain unchanged. In U.S. Pat. No. 5,207,873, for instance, the coating agent is a solution that is mainly made up of the following polymers: Teflon, urethane, and polyacrylamide. A coating agent provides a dirt repellent surface on the yarns of the wet wire.

It is an object of the invention to provide a fabric structure for use in paper machines and a method for manufacturing a fabric structure for use in paper machines, which eliminate the drawbacks of the prior art. This is achieved with the fabric structure and method of the invention. The fabric structure of the invention is characterized in that a coating material is arranged solely on the surface of a support structure at a predefined location(s) so that the coating material does not substantially alter the permeability properties of the support structure, and that the coating material is arranged to form bridges between elements forming the support structure. The method of the invention is, in turn, characterized in that the coating material is arranged solely on the surface of a support structure at a desired location(s) so that the permeability properties of the support structure remain substantially unchanged, and that the coating material forms bridges between elements forming the support structure. This means that after coating, the support structure can be used for the original purpose. For instance, if the support structure is designed to be a wet wire, its air permeability changes only a little and it can still be used as a wet wire.

Above all, the invention provides the advantage that it provides a very stable and wear-resistant fabric structure. The invention provides the further advantage that, with it, the coating is provided at a desired location on the paper side or wear side of the fabric structure. The coating can be made on the paper side or wear side or on both sides of the support structure. The coating can only be on the edge areas of the support structure, or the edge areas can be left without any coating. A coating on the edge areas of the support structure may be in bands of different thicknesses or in different patterns. The coating material of the invention does not penetrate into the support structure to clog the structure, so the dewatering ability of the support structure will thus not substantially decrease because of the coating material.

Figure 2:
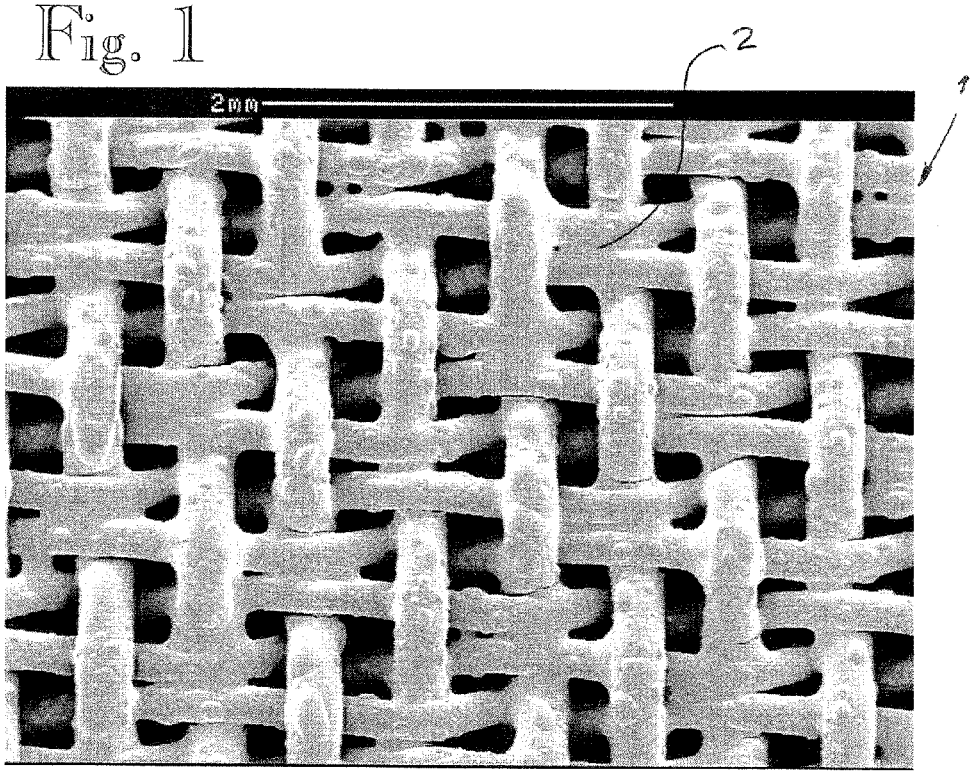
Figure 3:
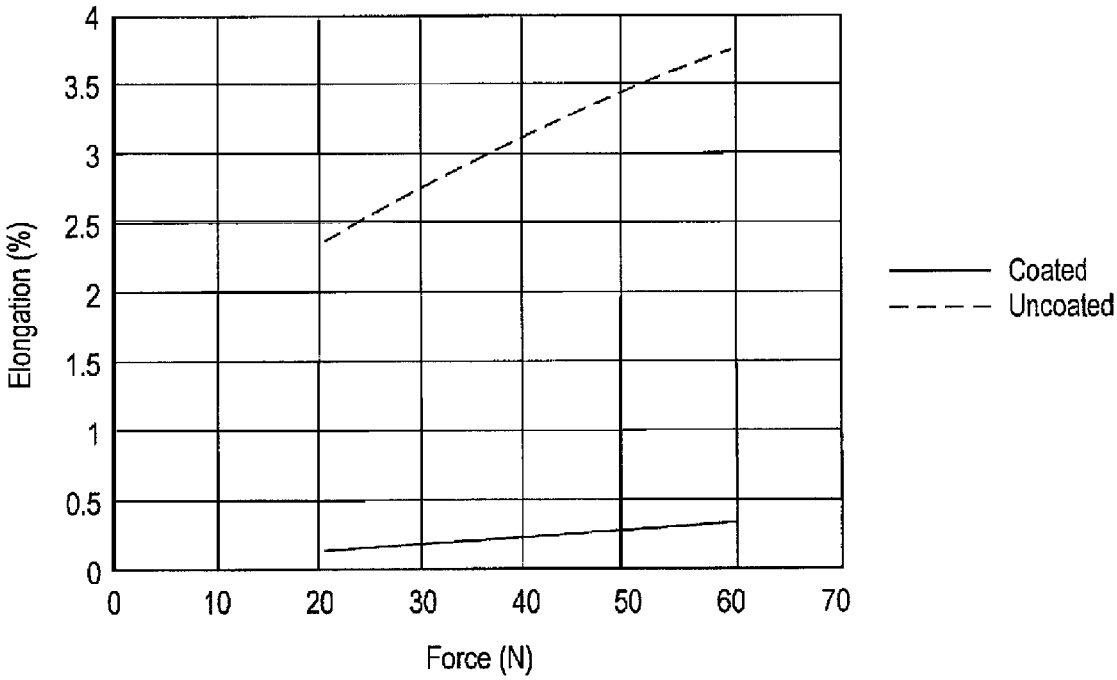

In the following, the invention will be described in more detail by means of an example described in the attached drawing, in which FIG. 1 shows an uncoated support structure, FIG. 2 shows a support structure coated according to the invention, and FIG. 3 shows a diagram comparing the stability of an uncoated support structure and one coated according to the invention.

FIG. 1 shows an uncoated support structure 1. The example in FIG. 1 shows a wet wire of a paper machine from the wear side. In the invention, a wet wire fabric according to FIG. 1, for instance, can serve as the support structure 1. However, it is clear that the invention is in no way limited to the support structure of FIG. 1, and the support structure can also be of some other type, as described later.

FIG. 2 shows a flexible and porous fabric structure of the invention comprising a support structure 1 and coating material 2. The coating material 2 can for instance be made of polymer, metal, composition metal, ceramic, or a mixture of the above-mentioned. The support structure 1 can, in turn, be a woven, knitted, wound, or non-woven structure, a warp-knit, a stitch-bonded fabric, or a perforated film. The structure of the figures is preferably obtained by coating the support structure 1 with an electrostatic or thermal coating method.

FIG. 2 shows, how the coating material 2 is attached to the surface of the yarns and forms bindings between the yarns. FIG. 2 shows clearly that the coating material 2 does not penetrate into the support structure 1 to clog the structure, whereby the permeability properties of the support structure remain substantially unchanged, i.e. for instance the dewatering ability does not substantially decrease, so a wet wire having the coating of the invention can be run in a paper machine in the same manner as a normal wet wire.

FIG. 3 shows a diagram comparing the stability of an uncoated fabric structure and a fabric structure of the invention, i.e. a coated fabric structure, as a function of the load. The diagram shows that the elongation of the coated support structure is smaller than that of the uncoated fabric structure. The comparison shown in diagram 3 is made with wet wire fabrics. FIG. 3 shows that the fabric structure of the invention is more stable in the paper machine than an uncoated fabric structure. The permeability of the uncoated fabric structure shown in the diagram is 5,900 m3/m2 h and that of the coated fabric structure is 5,200 m3/m2 h.

The electrostatic coating method is based on a phenomenon in which electrically opposite pieces attract each other. The coating material 2 is a polymer material in powder or liquid form. The coating material is charged electrically and the support structure to be coated is charged with electricity of opposite sign. The charged coating material particles then travel to the surface of the support structure 1 being treated due to electric forces. After coating, the coated support structure is treated so as to make the coating material melt and/or become a mesh and attach to the support structure.

Hot spraying is a general term for coating methods in which the coating material 2 and a possible additive are melted and the melt is applied as a thin spray at great velocity on the surface of the support structure 1 to form a coating. Metals, composition metals, ceramics, plastics, and mixtures thereof can be used as the coating material 2. There are several hot-spraying methods, such as plasma spraying, laser coating, and ARC coating. In plasma spraying, a powdery or linear coating material 2 is melted with an extremely hot gas. The melt coating material is taken to a flame with which the coating material is directed to the support structure to be coated. In laser coating, a laser beam is used instead of gas to melt the coating. In ARC coating, the support structure to be coated is placed in a vacuum chamber and pre-heated to a level required by the manufacturing process. The coating material 2 is vaporized by means of a gas discharge in the vacuum chamber. The support structure 1 to be coated is negatively charged and the coating material 2 is positively charged, so the support structure to be coated attracts the coating material. The coating material deposits ion by ion on the support structure being coated and forms a thin film on the surface of the support structure.

In a structure of the invention, bends are formed in the yarns of the structure during the thermal treatment of a conventionally woven wet wire. No bindings are formed between the bends and the bends remain separate from each other. During coating, the coating material 2 enters the spaces between the bends and forms bridges between the bends, thus improving the stability of the fabric.

Various dewatering elements and rolls of a paper machine wear the fabrics on the wear side. A coating of the invention on the wear side of the fabric, i.e. the support structure, protects the wear-side yarns and improves the wear resistance of the wet wire. In gap formers, wear occurs in the paper-side edge areas, and a coating on the paper side of the fabric improves the wear resistance of the fabric.

In a structure of the invention, the coating is on the edge areas of the fabric, i.e. support structure 1. This way, properties of the edge areas differ from those of the centre of the fabric. To make the edges more wear resistant, various coatings can be used to make reinforcement bands on the edges. The coating can also be arranged over the entire width of the support structure 1 or only on the centre area of the support structure 1, i.e. the web area of the wire.

In a structure of the invention, different coating materials are selected for the web area and the edge area of the wet wire. This type of coating affects the smoothness of the wet wire and the paper web then detaches more easily from the centre of the wire than from the edge areas. Such a solution facilitates the transfer of the paper web from the wet wire to a pick-up press felt. The actual paper web follows the pick-up press felt and the edges follow the wire.

In a structure of the invention, the coating of the edge areas increases the friction of the edge and thus reduces slipping on the rolls. This type of paper machine fabric can be used on the drying section of the paper machine in particular.

In a structure of the invention, a suitably selected wear-side coating material reduces friction between the paper machine fabric and the different elements of the paper machine and therefore also the load of the paper machine is reduced.

A coating on the paper side of the fabric increases the support surface of the fabric on the paper web, whereby mechanical retention improves and fibre transport decreases. A coating on the paper side smoothens the surface of the fabric, whereby markings caused by the fabric are eliminated. A suitable coating provides a dirt-repellent fabric, and keeping the fabric clean during operation becomes easier.

In a structure of the invention, short, for instance 0.1 to 0.3 mm, fibres are used instead of a powder or liquid. The fibres may be any textile fibres, such as polyester, polyamide, or bi-component fibres. The fabric and fibres are electrostatically charged to be of opposite signs, and staple fibres are spread on the surface of the fabric. The fibres are oriented in the desired manner in the fabric by means of the electric charge and/or by a spraying technique. Fixing the fibres is done by melting or with a binding agent.

A structure of the invention combines the support structure, fibre coating, and some other coating method of the invention.

In the above structures according to the invention, the support structure is woven. According to the basic idea of the invention, the coating can also be applied on a knitted fabric, a paper machine fabric made by winding, a non-woven structure, a warp-knit, a stitch-bonded fabric, or a perforated film.

In the above description, the invention is described by means of a wire intended for use in the wet end of a paper machine. The invention is naturally not in any way restricted to the above application, but may be freely applied within the scope of the attached claims; in other words, the invention can be used in any part of a paper machine, for instance in fabrics used in the wet end, press section, or drying section.

The invention claimed is:

1. A flexible and porous fabric structure, comprising:

a support structure; and a coating material for use in a paper machine, wherein the coating material is arranged solely on a surface of the support structure at predefined locations so that the coating material does not substantially alter permeability properties of the support structure, and that the coating material is arranged to form bridges to close spaces between bends of the support structure.

2. A fabric structure as claimed in claim 1, wherein the coating material is arranged on the surface of the support structure by electrostatic coating or thermal coating.

3. A fabric structure as claimed in claim 1, wherein the coating material is a polymer, metal, composition metal, ceramic, or a mixture of the polymer, metal, composition metal and ceramic.

4. A fabric structure as claimed in claim 1, wherein the support structure is a woven, knitted, wound, or non-woven structure, a warp-knit, a stitch-bonded fabric, or a perforated film.

5. A fabric structure as claimed in claim 1, wherein the coating material is arranged on a paper side of the support structure.

6. A fabric structure as claimed in claim 1, wherein the coating material is arranged on a wear side of the support structure.

7. A fabric structure as claimed in claim 1, wherein the coating material is arranged on paper and wear sides of the support structure.

8. A fabric structure as claimed in claim 1, wherein the coating material is arranged on an entire width of the support structure.

9. A fabric structure as claimed in claim 1, wherein the coating material is arranged on only a center area of the support structure.

10. A fabric structure as claimed in claim 1, wherein the coating material is arranged on only edge areas of the support structure.

11. A fabric structure as claimed in claim 1, wherein a center area and edge areas of the support structure have a different coating material.

12. A fabric structure as claimed in claim 10, wherein the coating of the edge areas is in bands.

13. A fabric structure as claimed in claim 10, wherein the coating of the edge areas is in different patterns.

14. A fabric structure as claimed in claim 1, wherein short fibres are used as the coating material.

15. A fabric structure as claimed in claim 1, wherein the coating material is of short fibres and one of the following: polymer, metal, composition metal, ceramic, or a mixture of the polymer, metal, composition metal and ceramic.

16. A fabric structure as claimed in claim 1, wherein the fabric structure is a structure used on a wet end, press section, or drying section of a paper machine.

17. A method for manufacturing a flexible and porous fabric structure for use in a paper machine, the method comprising arranging a coating material on a support structure, wherein the coating material is arranged solely on the surface of the support structure at desired locations so that permeability properties of the support structure remain substantially unchanged and that the coating material forms bridges to close spaces between bends of the support structure.

18. A method as claimed in claim 17, wherein the coating material is arranged on the surface of the support structure by electrostatic coating or thermal coating.

19. A method as claimed in claim 17, wherein the coating material is a polymer, metal, composition metal, ceramic, or a mixture of the polymer, metal, composition metal and ceramic.

20. A method as claimed in claim 17, wherein after coating the surface of the support structure with the coating material, the support structure is treated to make the coating material at least one of melt or become a mesh, and attach to the support structure.

21. A method as claimed in claim 17, wherein the support structure is a woven, knitted, wound, or non-woven structure, a warp-knit, a stitch-bonded fabric, or a perforated film.

22. A method as claimed in claim 17, wherein the coating material is arranged on a paper side of the support structure.

23. A method as claimed in claim 17, wherein the coating material is arranged on a wear side of the support structure.

24. A method as claimed in claim 17, wherein the coating material is arranged on paper and wear sides of the support structure.

25. A method as claimed in claim 17, wherein the coating material is arranged on the entire width of the support structure.

26. A method as claimed in claim 17, wherein the coating material is arranged on only a center area of the support structure.

27. A method as claimed in claim 17, wherein the coating material is arranged on only edge areas of the support structure.

28. A method as claimed in claim 17, characterized in that a different coating material is arranged on a center area and edge areas of the support structure.

29. A method as claimed in claim 27, wherein the coating of the edge areas is in bands.

30. A method as claimed in claim 27, wherein the coating of the edge areas is in different patterns.

31. A method as claimed in claim 17, wherein short fibre is used as the coating material.

32. A method as clamed in claim 17, wherein the coating material is of short fibres and one of polymer, metal, composition metal, ceramic, or a mixture of the polymer, metal, composition metal and ceramic.

* * * * *